US008142573B2

(12) United States Patent
Kobayashi et al.

(10) Patent No.: US 8,142,573 B2
(45) Date of Patent: Mar. 27, 2012

(54) R-T-B SINTERED MAGNET AND METHOD FOR PRODUCING THE SAME

(75) Inventors: Hiroya Kobayashi, Osaka (JP); Futoshi Kuniyoshi, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 279 days.

(21) Appl. No.: 12/595,293

(22) PCT Filed: Apr. 11, 2008

(86) PCT No.: PCT/JP2008/000957

§ 371 (c)(1),
(2), (4) Date: Oct. 9, 2009

(87) PCT Pub. No.: WO2008/132801

PCT Pub. Date: Nov. 6, 2008

(65) Prior Publication Data

US 2010/0045411 A1 Feb. 25, 2010

(30) Foreign Application Priority Data

Apr. 13, 2007 (JP) ..... 2007-106051

(51) Int. Cl.
*H01F 1/057* (2006.01)

(52) U.S. Cl. ..... 148/302; 148/101; 420/83; 420/121

(58) Field of Classification Search ..... None
See application file for complete search history.

(56) References Cited

U.S. PATENT DOCUMENTS

| | | | | |
|---|---|---|---|---|
| 5,383,978 | A | 1/1995 | Yamamoto et al. | |
| 6,468,365 | B1 | 10/2002 | Uchida et al. | |
| 2004/0020563 | A1 * | 2/2004 | Tokuhara et al. | 148/105 |
| 2005/0098238 | A1 * | 5/2005 | Morimoto et al. | 148/302 |
| 2009/0019969 | A1 | 1/2009 | Kato et al. | |
| 2009/0020193 | A1 | 1/2009 | Ohta et al. | |

FOREIGN PATENT DOCUMENTS

| | | | |
|---|---|---|---|
| EP | 1 860 668 | A1 * | 11/2007 |
| JP | 57-148566 | A | 9/1982 |
| JP | 57-189274 | U | 12/1982 |
| JP | 57-189275 | U | 12/1982 |
| JP | 58-029358 | A | 2/1983 |
| JP | 58-174977 | U | 11/1983 |
| JP | 59-117281 | U | 8/1984 |

(Continued)

OTHER PUBLICATIONS

Official Communication issued in International Patent Application No. PCT/JP2008/000957, mailed on Jul. 22, 2008.

(Continued)

*Primary Examiner* — John Sheehan
(74) *Attorney, Agent, or Firm* — Keating & Bennett, LLP

(57) ABSTRACT

An R-T-B based sintered magnet includes both a light rare-earth element $R_L$ (which is at least one of Nd and Pr) and a heavy rare-earth element $R_H$ (which is at least one of Dy and Tb) and $Nd_2Fe_{14}B$ type crystals as a main phase. The magnet has a first region, which includes either the heavy rare-earth element $R_H$ in a relatively low concentration or no heavy rare-earth elements $R_H$ at all, and a second region, which includes the heavy rare-earth element $R_H$ in a relatively high concentration. The first and second regions are combined together by going through a sintering process.

16 Claims, 3 Drawing Sheets

FOREIGN PATENT DOCUMENTS

| | | | | |
|---|---|---|---|---|
| JP | 61-059705 | A | | 3/1986 |
| JP | 11-329809 | A | | 11/1999 |
| JP | 2007-258455 | | * | 10/2007 |
| JP | 2007-273815 | | * | 10/2007 |
| WO | WO 2006/098204 | | * | 9/2006 |
| WO | WO 2006/112403 | A1 | * | 10/2006 |

OTHER PUBLICATIONS

English translation of Official Communication issued in corresponding International Application PCT/JP2008/000957, mailed on Oct. 22, 2009.

* cited by examiner

R-T-B SINTERED MAGNET AND METHOD FOR PRODUCING THE SAME

BACKGROUND OF THE INVENTION

1. Field of the Invention

The present invention relates to an R-T-B based sintered magnet for use to make motors for cars and a method of producing such a magnet.

2. Description of the Related Art

An R-T-B based rare-earth sintered magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. When used in motors and various other devices, the R-T-B based rare-earth sintered magnet should exhibit thermal resistance and coercivity that are high enough to withstand an operating environment at an elevated temperature.

To increase the coercivity of an R-T-B based rare-earth sintered magnet, an alloy, obtained by mixing together not only a light rare-earth element $R_L$ but also a predetermined amount of heavy rare-earth element $R_H$ as rare-earth elements R in the material and then melting the mixture, has been used. According to this method, the light rare-earth element $R_L$, which is included as a rare-earth element R in an $R_2Fe_{14}B$ main phase, is replaced with the heavy rare-earth element $R_H$, and therefore, the magnetocrystalline anisotropy (which is a decisive quality parameter that determines the coercivity) of the $R_2Fe_{14}B$ phase improves.

However, although the magnetic moment of the light rare-earth element $R_L$ in the $R_2Fe_{14}B$ phase has the same direction as that of Fe, the magnetic moments of the heavy rare-earth element $R_H$ and Fe have mutually opposite directions. That is why the remanence $B_r$ would decrease in proportion to the percentage of the light rare-earth element $R_L$ replaced with the heavy rare-earth element $R_H$.

A magnet for use in motors, for example, should have not only high remanence $B_R$ at least in its portion to be used for a driving section but also high coercivity at least in its portion to be exposed to intense heat or a great demagnetizing field.

For that purpose, according to a conventional technique, a magnet with high remanence $B_r$ and a magnet with high coercivity $H_{cJ}$ are bonded and combined together with an adhesive, and a combined magnet thus obtained is used in motors and various other machines. If such a combined magnet needs to be made, however, it takes extra time to complete that bonding process, thus causing a decrease in productivity. What is worse, if a lot of adhesive must be used to bond the two different magnets together, a magnetically discontinuous layer would be formed by the adhesive.

Meanwhile, methods for forming such a combined magnet without using any adhesive have also been proposed in Japanese Patent Application Laid-Open Publication No. 57-148566 and Japanese Utility Model Application Laid-Open Publication No. 59-117281. Specifically, Japanese Patent Application Laid-Open Publication No. 57-148566 discloses a field composite permanent magnet produced by compacting together one material with higher remanence than others and the other material with higher coercivity than others and then sintering the compact.

On the other hand, Japanese Utility Model Application Laid-Open Publication No. 59-117281 discloses field permanent magnets with an arc cross section that together form a permanent magnet for a DC machine. Specifically, in each of those field permanent magnets, only a portion near the surface of its inner arc and around the edge of its inner end surface on the demagnetizing side is designed to be a permanent magnet with higher coercivity than the body permanent magnet.

However, the techniques disclosed in both of these documents are supposed to be used to make ferrite magnets, and will not meet the demands for reducing the size of motors or improving the performance thereof. On top of that, as materials with mutually different compositions are combined together through sintering, such a combined magnet is likely to be deformed during the sintering process. And the higher the temperature at which such a magnet is used, the more easily the magnet will crack from their junction due to a difference in sintering shrinkage rate between those materials.

To make magnets for EPS and HEV motors, for which there should be growing demands from the markets in the near future, R-T-B based sintered magnets with essentially good magnetic properties need to be used effectively. And a lot of people are waiting for development of a technology for making an R-T-B based sintered magnet including both a region with high remanence $B_r$ and a region with high coercivity $H_{cJ}$.

SUMMARY OF THE INVENTION

In view of the above, preferred embodiments of the present invention provide an R-T-B based sintered magnet including a region with high remanence $B_r$ and a region with high coercivity $H_{cJ}$ at predetermined locations, without using any adhesive.

In addition, preferred embodiments of the present invention provide a method for producing such an R-T-B based sintered magnet including regions with mutually different magnetic properties without deforming the magnet in the process step of combining materials with different compositions together and sintering the mixture so that the resultant sintered magnet will have sufficiently high bond strength.

An R-T-B based sintered magnet according to a preferred embodiment of the present invention includes both a light rare-earth element $R_L$, which is at least one of Nd and Pr, and a heavy rare-earth element $R_H$, which is at least one of Dy and Tb, and $Nd_2Fe_{14}B$ type crystals as a main phase. A first region, which includes either the heavy rare-earth element $R_H$ in a relatively low concentration or no heavy rare-earth elements $R_H$ at all, and a second region, which includes the heavy rare-earth element $R_H$ in a relatively high concentration, are stacked in layers. The first and second regions are combined together by going through a sintering process.

In one preferred embodiment, the R-T-B based sintered magnet further includes a shrinkage reducer M, which is at least one element selected from the group consisting of C, Al, Co, Ni, Cu and Sn.

In this particular preferred embodiment, the shrinkage reducer M has a higher concentration in the first region than in the second region.

In a specific preferred embodiment, the first region includes, for example, about 50 ppm to about 3,000 ppm of C as M1 that is one of the shrinkage reducers M.

In another preferred embodiment, the first region includes at least one element selected from the group consisting of Al, Co, Ni, Cu and Sn as M2 that is another one of the shrinkage reducers M, and the content of M2 is equal to or greater than about 0.02 mass %, for example.

In still another preferred embodiment, each of the first and second regions has a thickness of at least about 0.1 mm and the magnet has a thickness of at least about 1.0 mm, for example.

In yet another preferred embodiment, there is a region in which the heavy rare-earth element $R_H$ has diffused on a boundary between the first and second regions.

In yet another preferred embodiment, there is a region in which the concentration of the heavy rare-earth element $R_H$ has a gradient on a boundary between the first and second regions.

In this particular preferred embodiment, a portion of the first and second regions, which covers the surface of the magnet at least partially, includes a portion in which the heavy rare-earth element $R_H$ has a constant concentration from the surface of the magnet toward the boundary.

A method for producing an R-T-B based sintered magnet according to another preferred embodiment of the present invention is designed to produce an R-T-B based sintered magnet that includes both a light rare-earth element $R_L$ (which is at least one of Nd and Pr) and a heavy rare-earth element $R_H$ (which is at least one of Dy and Tb) and $Nd_2Fe_{14}B$ type crystals as a main phase. The method includes the steps of: providing a first material alloy powder, which includes either the heavy rare-earth element $R_H$ in a relatively low concentration or no heavy rare-earth elements $R_H$ at all, and a second material alloy powder, which includes the heavy rare-earth element $R_H$ in a relatively high concentration; forming a composite compact including a first compact portion made of the first material alloy powder and a second compact portion made of the second material alloy powder; and sintering the composite compact, thereby making a sintered magnet in which the first and second compact portions have been combined together.

In one preferred embodiment, the step of forming the composite compact includes: a first forming process step for forming a temporary compact by loading a cavity, defined by a die, with one of the first and second material alloy powders and compressing the material alloy powder; and a second forming process step for forming the composite compact by loading the cavity defined by the die with the other alloy powder and compressing the material alloy powder along with the temporary compact.

In another preferred embodiment, the step of forming the composite compact includes the steps of: providing the first compact portion made of the first material alloy powder; providing the second compact portion made of the second material alloy powder; and compressing the first and second compact portions, thereby forming the composite compact in which the first and second compact portions have been combined together.

In still another preferred embodiment, the step of forming the composite compact includes the steps of: providing the first compact portion made of the first material alloy powder; providing the second compact portion made of the second material alloy powder; and stacking the first and second compact portions one upon the other, thereby forming the composite compact in which the first and second compact portions are in contact with each other.

In yet another preferred embodiment, the first and second material alloy powders include a shrinkage reducer M, which is at least one element selected from the group consisting of C, Al, Co, Ni, Cu and Sn, and the shrinkage reducer M has a higher concentration in the first material alloy powder than in the second material alloy powder.

In yet another preferred embodiment, the first material alloy powder has a finer particle size than the second material alloy powder.

In yet another preferred embodiment, in the step of forming the composite compact, the first compact portion made of the first material alloy powder has a higher green density than the second compact portion made of the second material alloy powder.

According to various preferred embodiments of the present invention, a region with high remanence $B_r$ and a region with high coercivity $H_{cJ}$ are formed as integral portions of a magnet by a sintering process, and a heavy rare-earth element $R_H$ is diffused in the junction between those two regions. As a result, the two regions can be combined together firmly without using any adhesive.

In addition, by changing some process parameters such as a green density according to a difference in the concentration of the heavy rare-earth element $R_H$ between the compact portions to be combined together, the deformation, which would otherwise be caused due to a difference in thermal shrinkage rate during the sintering process of a magnet if the heavy rare-earth element $R_H$ had varying concentrations, can be minimized.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
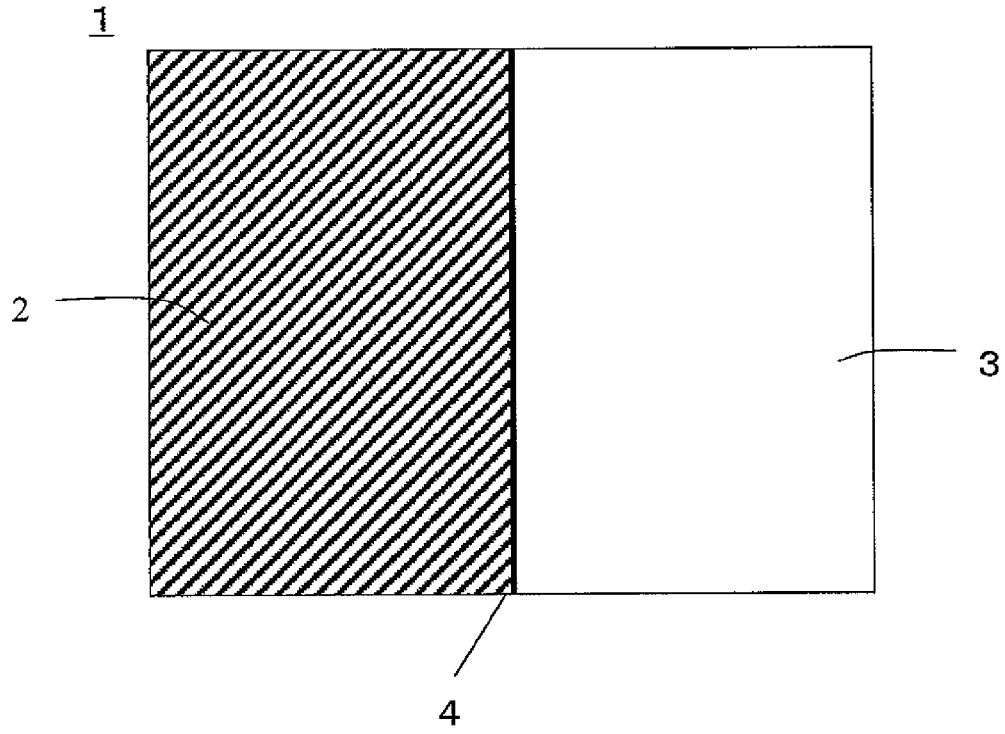
FIG. 1 is a schematic representation illustrating a cross section of a sintered body in which multiple compacts with mutually different compositions have been stacked one upon the other and firmly combined together through sintering.

An R-T-B based sintered magnet according to a preferred embodiment of the present invention includes both a light rare-earth element $R_L$ (which is at least one of Nd and Pr) and a heavy rare-earth element $R_H$ (which is at least one of Dy and Tb) and $Nd_2Fe_{14}B$ type crystals as a main phase. In this sintered magnet, a first region, which includes either the heavy rare-earth element $R_H$ in a relatively low concentration (or mole fraction) or no heavy rare-earth elements $R_H$ at all, and a second region, which includes the heavy rare-earth element $R_H$ in a relatively high concentration, are stacked in layers. The first region including the heavy rare-earth element $R_H$ at either a relatively low concentration or zero concentration will be referred to herein as a "high Br portion" and the second region including the heavy rare-earth element $R_H$ in a relatively high concentration will be referred to herein as a "high coercivity portion" for the sake of simplicity. One of the unique features of preferred embodiments of the present invention lies in that the high coercivity portion and the high Br portion are combined together by the sintering process, instead of being bonded with an adhesive as is done in the prior art.

In the "R-T-B based" magnet, the main ingredient of T is Fe, a portion of which (e.g., at most 50 at %) could be replaced with another transition metal element (such as Co or Ni) according to a preferred embodiment of the present invention, and B is boron. The magnet preferably further includes at least one element selected from the group consisting of C, Al, Co, Ni, Cu and Sn as a shrinkage reducer M. As will be described later, if the shrinkage reducer M is included, the deformation that would otherwise be caused due to a difference in thermal shrinkage rate between compact portions during the sintering process can be reduced significantly.

The shrinkage reducer M preferably has a higher concentration in the first region than in the second region. Approximately 50 ppm to 3,000 ppm of C, for example, is preferably included as M1 that is one of the shrinkage reducers M. In addition, at least about 0.02 mass % of Al, Co, Ni, Cu and/or Sn, for example, is also preferably included as M2 that is another one of the shrinkage reducers M.

An R-T-B based sintered magnet according to a preferred embodiment of the present invention may be produced by performing the steps of: providing a first material alloy powder, which includes either the heavy rare-earth element $R_H$ in a relatively low concentration or no heavy rare-earth elements $R_H$ at all, and a second material alloy powder, which includes the heavy rare-earth element $R_H$ in a relatively high concentration; forming a composite compact including a first compact portion made of the first material alloy powder and a second compact portion made of the second material alloy powder; and sintering the composite compact, thereby making a sintered magnet in which the first and second compact portions have been combined together.

In one preferred embodiment, each layer of the R-T-B based sintered magnet according to a preferred embodiment of the present invention has a thickness of at least about 0.1 mm and the magnet has a thickness of at least about 1.0 mm, for example.

Hereinafter, an exemplary makeup of the R-T-B based sintered magnet according to a preferred embodiment of the present invention will be described with reference to FIGS. 1 and 2. Specifically, FIG. 1 is a cross-sectional view illustrating an exemplary makeup of the R-T-B based sintered magnet 1 and FIG. 2 schematically illustrates the internal structure of the magnet.

The R-T-B based sintered magnet 1 illustrated in these drawings has a structure in which a layered region 2 with a composition including $R_H$ in a relatively high concentration (i.e., a high coercivity portion) and another layered region 3 with a composition including $R_H$ in a lower concentration than the region 2 (i.e., a high Br portion) are combined together via a junction portion 4. That is to say, in this R-T-B based sintered magnet 1, the region 2 including a lot of $R_H$ and having high coercivity $H_{cJ}$ (i.e., the high coercivity portion) and the region 3 including less $R_H$ and having high remanence $B_r$ (i.e., the high Br portion) are stacked in layers and combined together.

Figure 2:
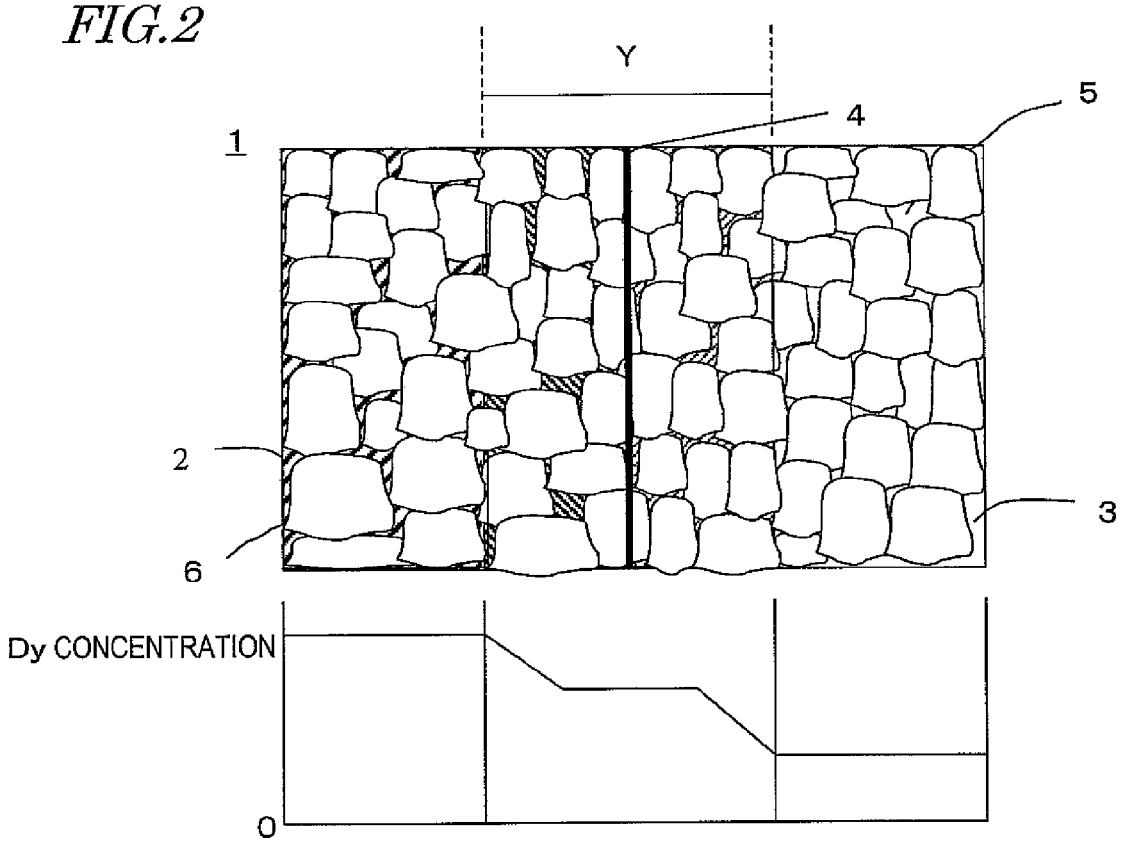
FIG. 2 schematically illustrates the internal structure of the magnet shown in FIG. 1.

The magnet structure illustrated in FIG. 2 includes a main phase 5 consisting of an $Nd_2Fe_{14}B$ type crystal and a grain boundary phase 6 that surrounds the main phase 5. The grain boundary phase 6 is a rare-earth-rich phase to be a liquid phase during the sintering process.

In the vicinity of the junction portion 4, $R_H$ has been interdiffused between the regions 2 and 3, thereby combining these two regions 2 and 3 together firmly. As shown in FIG. 2, in this $R_H$ diffused region (i.e., the region Y), the concentration of $R_H$ tends to decrease gradually as a whole from the region 2 toward the region 3.

To combine the regions 2 and 3 together with the $R_H$ diffused region Y interposed between them, the sintering temperature is preferably defined within the range of 1,000° C. to 1,150° C. Optionally, to improve the magnetic properties, the magnet may be subjected to a heat treatment at a temperature of 400° C. to 700° C. If necessary, the heat treatment temperature could be raised to an even higher value (of 800° C. to less than 1,000° C., for example).

The R-T-B based sintered magnet according to a preferred embodiment of the present invention may be produced in the following manner, for example.

First of all, a compact made of an R-T-B based sintered magnet material alloy with a composition including $R_H$ as a rare-earth element R at either a relatively low concentration or even zero concentration is provided. In the meantime, a compact made of an R-T-B based sintered magnet material alloy including a heavy rare-earth element $R_H$ (which is at least one of Dy, Ho and Tb) as a rare-earth element R in a relatively high concentration is also provided.

Next, these compacts are stacked one upon the other either during a compaction process or at the start of a sintering process and then sintered together. The region made of the former R-T-B based rare-earth sintered magnet material alloy with such a composition including $R_H$ as a rare-earth element R at either a relatively low concentration or even zero concentration will be a region with high remanence $B_r$. On the other hand, the region made of the latter R-T-B based sintered magnet material alloy including the heavy rare-earth element $R_H$ in a relatively high concentration will be a region with high coercivity. As a result, an R-T-B based sintered magnet, including such a region with high remanence $B_r$ and such a region with high coercivity $H_{cJ}$, is obtained.

Figure 3:
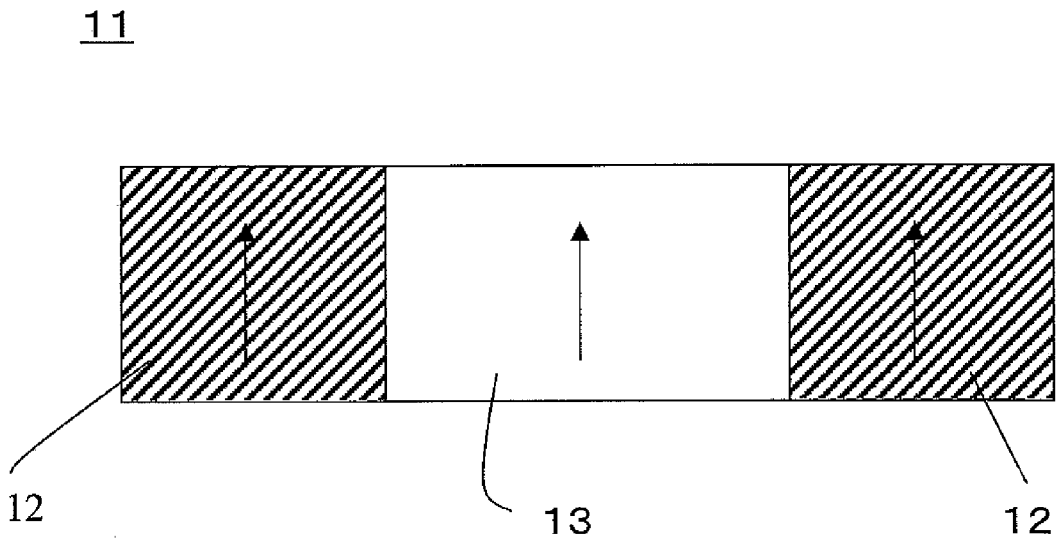
FIG. 3 illustrates a specific example of a preferred embodiment of the present invention.
Figure 4:
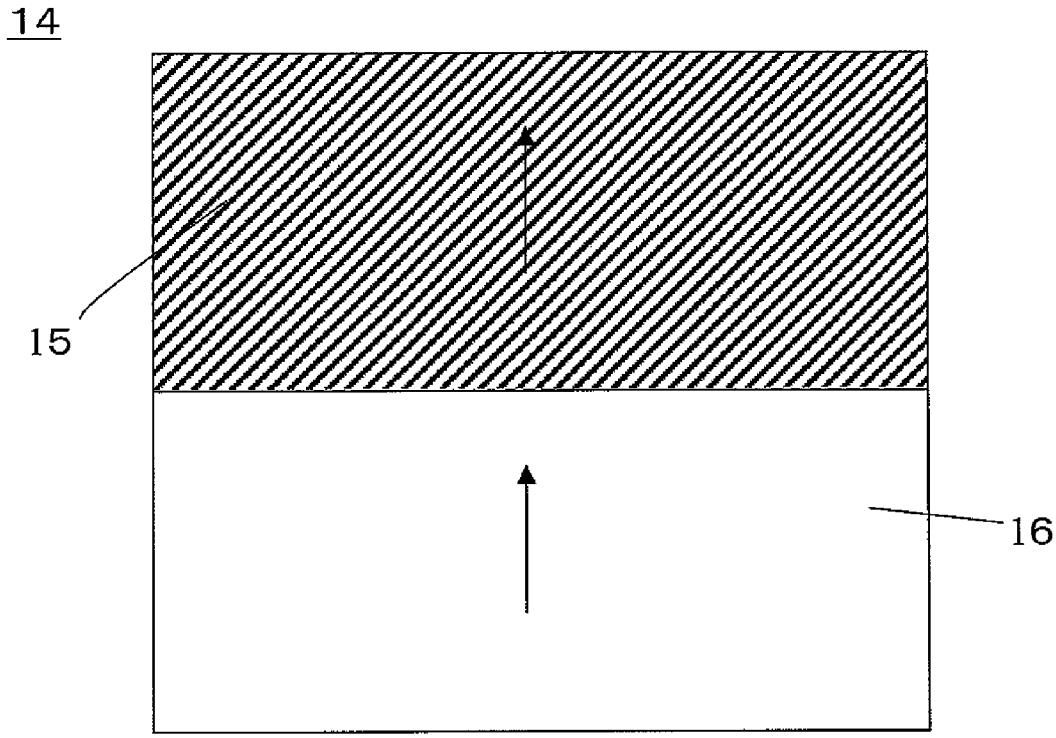
FIG. 4 illustrates another specific example of a preferred embodiment of the present invention.
Figure 5:
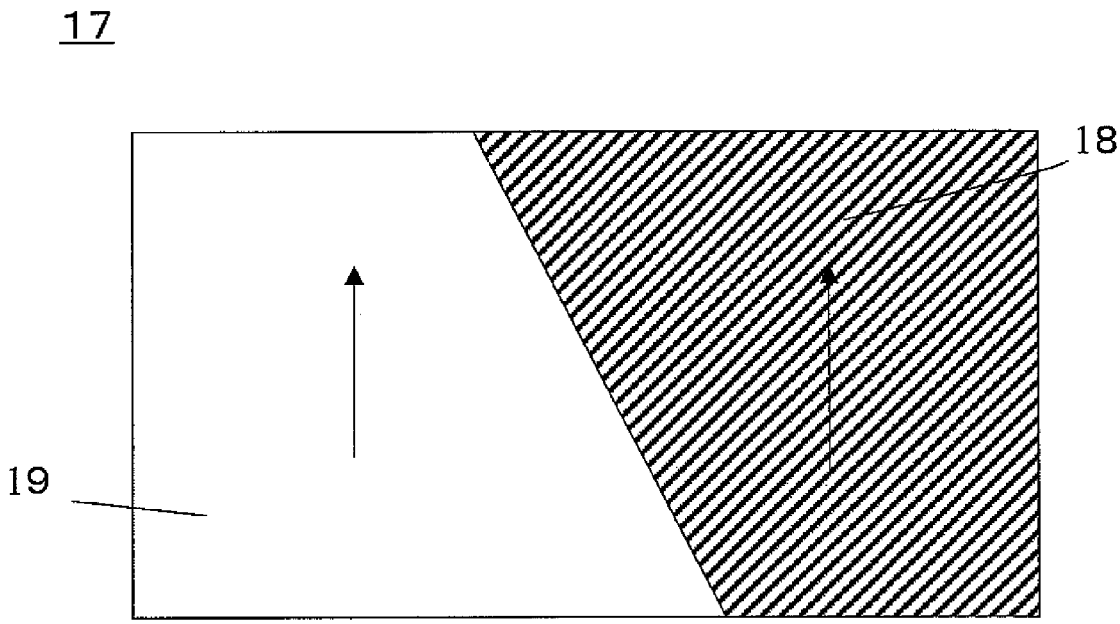
FIG. 5 illustrates still another specific example of a preferred embodiment of the present invention.

According to the manufacturing process described above, by combining multiple types of compacts together, the region including the heavy rare-earth element $R_H$ in a relatively high concentration can be arranged at an arbitrary position. FIGS. 3, 4 and 5 are cross-sectional views illustrating exemplary arrangements for an R-T-B based sintered magnet according to a preferred embodiment of the present invention that has been produced by the method described above. In these drawings, the arrows indicate the direction of magnetic field alignment.

Specifically, in the plate sintered magnet 11 shown in FIG. 3, both end portions 12 thereof are regions including the heavy rare-earth element $R_H$ in a relatively high concentration, while the center portion 13 thereof is a region including, as rare-earth elements R, the heavy rare-earth element $R_H$ in a relatively low concentration and a light rare-earth element $R_L$ in a relatively high concentration.

On the other hand, in the plate sintered magnet 14 shown in FIG. 4, the upper portion 15 thereof is a region including the heavy rare-earth element $R_H$ in a relatively high concentration, while the lower portion 16 thereof is a region including, as rare-earth elements R, the heavy rare-earth element $R_H$ in a relatively low concentration and a light rare-earth element $R_L$ in a relatively high concentration.

Likewise, in the plate sintered magnet 17 shown in FIG. 5, the upper portion 18 thereof is a region including the heavy rare-earth element $R_H$ in a relatively high concentration, while the lower portion 19 thereof is a region including, as rare-earth elements R, the heavy rare-earth element $R_H$ in a relatively low concentration and a light rare-earth element $R_L$ in a relatively high concentration.

In each of the examples illustrated in FIGS. 3, 4 and 5, multiple regions including the heavy rare-earth element $R_H$ at mutually different concentrations have the same magnetic field alignment direction.

According to a preferred embodiment of the present invention, in the overall magnet in which multiple compacts have been combined together by going through a sintering process, the very small amount of heavy rare-earth element $R_H$ can be concentrated only in a local region and a region with high coercivity $H_{cJ}$ can be defined selectively. That is why there is no need to add the heavy rare-earth element $R_H$ unnecessarily to a region of a sintered magnet to which no demagnetizing field is applied, and therefore, the remanence $B_r$ can be increased in that region. In addition, since no adhesive is used, the problems already described about the prior art can be avoided.

Hereinafter, an example of a preferred embodiment of a method for producing an R-T-B based sintered magnet according to the present invention will be described in further detail.

Material Alloy #1

First, an alloy including 16.0 mass % to 36.0 mass % of a light rare-earth element $R_L$, 0 mass % to 15 mass % of a heavy rare-earth element $R_H$ (which is one or both of Dy and Th), 0.5 mass % to 2.0 mass % of B (boron) and Fe and inevitably contained impurities as the balance is provided. A portion (50 at % or less) of Fe may be replaced with another transition metal element such as Co or Ni. For various purposes, this alloy may contain about 0.01 mass % to about 1.0 mass % of at least one additive element that is selected from the group consisting of Al, Si, Ti, V, Cr, Mn, Ni, Cu, Zn, Ga, Zr, Nb, Mo, Ag, In, Sn, Hf, Ta, W, Pb and Bi.

Such an alloy is preferably made by quenching a melt of a material alloy by strip casting method, for example. Hereinafter, a method of making a rapidly solidified alloy by strip casting method will be described.

First, a material alloy with the composition described above is melted by induction heating process within an argon atmosphere to obtain a melt of the material alloy. Next, this melt is kept heated at about 1,350° C. and then quenched by single roller process, thereby obtaining a flake-like alloy block with a thickness of about 0.3 mm. Then, the alloy block thus obtained is pulverized into flakes with a size of 1 mm to 10 mm before being subjected to the next hydrogen pulverization process. Such a method of making a material alloy by strip casting method is disclosed in U.S. Pat. No. 5,383,978, for example.

Material Alloy #2

Another material alloy is obtained just like Material Alloy #1 except that an alloy including 16.0 mass % to 35.0 mass % of a light rare-earth element $R_L$, 0.5 mass % to 15.0 mass % of a heavy rare-earth element $R_H$ (which is one or both of Dy and Th), 0.5 mass % to 2.0 mass % of B (boron) and Fe and inevitably contained impurities as the balance is provided.

In the preferred embodiment of the present invention described above, two kinds of material alloys (i.e., Material Alloys #1 and #2) preferably are supposed to be used. Optionally, other material alloys could be used as well in addition to those Material Alloys #1 and #2.

The major difference between these Material Alloys #1 and #2 is that Material Alloy #1 includes the heavy rare-earth element $R_H$ in a lower concentration than Material Alloy #2. Moreover, Material Alloy #1 does not have to include the heavy rare-earth element $R_H$ in the first place.

Furthermore, by adjusting the respective total R mole fractions of Material Alloys #1 and #2 and the mole fractions of their $R_H$ to most appropriate values and by reducing the difference in thermal shrinkage rate during the sintering process to 1.5% or less, the deformation that would otherwise be caused due to the difference in thermal shrinkage rate during the sintering process to make the sintered magnet is minimized. It will be described in detail later exactly how to narrow the difference in thermal shrinkage rate.

Coarse Pulverization Process

Next, the alloy block (including Material Alloys #1 and #2) that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually improve the magnetic properties of the resultant magnet.

As a result of this hydrogen pulverization process, the rare-earth alloy (including Material Alloys #1 and #2) is pulverized to sizes of about 0.1 mm to several millimeters with a mean particle size of 500 μm or less. After the hydrogen pulverization, the decrepitated material alloy is preferably further crushed to finer sizes and quenched. If the material alloy unloaded still has a relatively high temperature, then the alloy should be quenched for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and causes the powder to be further pulverized by its pulverizer. The powder, which has been pulverized by the pulverizer, is then collected in a collecting tank by way of the cyclone classifier. In this manner, a finely pulverized powder with sizes D50 of about 0.1 μm to about 20 μm (typically 3 μm to 5 μm) when measured by laser diffraction method with dry dispersion can be obtained. The pulverizing machine for use in such a fine pulverization process does not have to be a jet mill but may also be an attritor or a ball mill. Optionally, a lubricant such as zinc stearate may be added as an aid for the pulverization process.

In this process, at least one element selected from the group consisting of C, Al, Co, Ni, Cu and Sn (which may be 50 ppm to 3,000 ppm of C as M1 and 0.02 mass % or more of at least one of Al, Co, Ni, Cu and Sn as M2) is preferably added as a shrinkage reducer M in the form of a compound or a metal powder to the material alloy powder. If the shrinkage reducer and the material alloy powder are mixed together, it is possible to minimize the deformation that would otherwise be caused due to a difference in thermal shrinkage rate when powders or compacts made of material alloys with different compositions are stacked one upon the other and sintered.

Press Compaction Process

In this preferred embodiment, 0.3 mass % of lubricant is added to the magnetic powder (i.e., alloy powder) obtained by the method described above and then they are mixed in a rocking mixer. In this process step, a lubricant including C such as zinc stearate may be used.

Next, the magnetic powder prepared as Material Alloy #1 by the method described above is compacted under an aligning magnetic field using a known press machine so that a temporary compact will have an apparent density of approximately 2.5 to 4.8 g/cm$^3$. Thereafter, a magnetic powder made of Material Alloy #2 is loaded and then compacted under an aligning magnetic field so that the compact will have a green density of approximately 3.5 to 4.8 g/cm$^3$. In this manner, a composite compact, comprised of a first compact portion made of the powder of Material alloy #1 and a second compact portion made of the powder of Material alloy #2, is obtained.

Optionally, the "composite compact" may also be formed by making two compacts with a green density of approximately 3.5 to 4.8 g/cm$^3$ separately of the magnetic powders of Material Alloys #1 and #2 and then stacking those two compacts one upon the other with load placed on them. As used herein, the "composite compact" is a combination of a compact made of the material alloy powder including the heavy rare-earth element $R_H$ in a relatively low concentration and a compact made of the material alloy powder including the heavy rare-earth element $R_H$ in a relatively high concentration. These two compacts do not have to be firmly combined together before subjected to the sintering process. Even if these two compacts are just stacked one upon the other and only contact with each other due to the weight of the upper compact, the combination can still be called a "composite compact".

The aligning magnetic field to be applied during the compaction process to make the temporary compact or the compacts may have a strength of 1.5 to 1.7 tesla (T), for example.

Sintering Process

The powder compact described above is preferably sequentially subjected to the process of maintaining the compact at a temperature of 300° C. to 900° C. for 30 to 120 minutes and then to the process of further sintering the compact at a higher temperature (of 1,000° C. to 1,150° C., for example) than in the maintaining process. Particularly when a liquid phase is produced during the sintering process (i.e., when the temperature is in the range of 800° C. to 1,000° C.), the R-rich phase on the grain boundary starts to melt to produce the liquid phase. Thereafter, the sintering process advances to form a sintered magnet eventually. The sintered magnet may then be subjected to an aging treatment (at a temperature of 700° C. to 1,000° C.) if necessary.

EXAMPLES

Example 1

First, an ingot of Material Alloy #1 that had been prepared so as to have a composition including 26.0 mass % of Nd, 5.0 mass % of Pr, less than mass % of Dy, 1.00 mass % of B, 0.90 mass % of Co, 0.1 mass % of Cu, 0.20 mass % of Al, and Fe as the balance was melted, quenched and solidified by strip casting method as described above, thereby making thin alloy flakes with thicknesses of 0.2 mm to 0.3 mm.

In the meantime, an ingot of Material Alloy #2 that had been prepared so as to have a composition including 16.5 mass % of Nd, 5.0 mass % of Pr, 10.00 mass % of Dy, 1.00 mass % of B, 0.90 mass % of Co, 0.1 mass % of Cu, mass % of Al, and Fe as the balance was also melted, quenched and solidified by strip casting method as described above, thereby making thin alloy flakes with thicknesses of 0.2 mm to 0.3 mm.

Next, two containers were loaded with these two types of thin alloy flakes and then introduced into a furnace for hydrogen absorption, which was filled with a hydrogen gas atmosphere at a pressure of 500 kPa. In this manner, hydrogen was absorbed within the thin alloy flakes at room temperature and then desorbed. By performing such a hydrogen process, the alloy flakes were decrepitated to obtain a powder in indefinite shapes with sizes of about mm to about 0.2 mm.

Thereafter, 0.05 mass % of zinc stearate was added as an aid for pulverization to each coarsely pulverized powder obtained by the hydrogen process and then the mixture was pulverized with a jet mill to obtain fine powders with a particle size of approximately 4 μm. After that, 0.1 mass % of zinc stearate was further added to each of the finely pulverized powders and then mixed with the powder, thereby adjusting the content of C to 1,000 ppm in each finely pulverized powder.

Among the fine powders thus obtained, the fine powder made of Material Alloy #1 was compacted provisionally with a press machine to have a green density of 4.0 g/cm$^3$. And then the fine powder made of Material Alloy #2 was loaded to make a powder compact with a green density of 4.2 g/cm$^3$. More specifically, the powder particles of Material Alloy #1 were compressed and compacted while being aligned with a magnetic field of 1.5 T applied. Subsequently, the powder particles of Material Alloys #1 and #2 were compressed and compacted while being aligned with a magnetic field of 1.5 T applied. And then the green compact was unloaded from the press machine and then subjected to a sintering process at 1,050° C. for four hours in a vacuum furnace.

In this manner, sintered blocks were obtained and then machined and cut into sintered magnet bodies with a thickness of 3 mm, a length of 14 mm (in the magnetizing direction) and a width of 8 mm (in the compacting direction).

Example 2

First, an ingot of Material Alloy #1 that had been prepared so as to have a composition including 26.0 mass % of Nd, 5.0 mass % of Pr, less than 0.05 mass % of Dy, 1.00 mass % of B, 0.90 mass % of Co, 0.1 mass % of Cu, 0.20 mass % of Al, and Fe as the balance was melted with a strip caster and then quenched and solidified, thereby making thin alloy flakes with thicknesses of 0.2 mm to 0.3 mm.

In the meantime, an ingot of Material Alloy #2 that had been prepared so as to have a composition including 16.5 mass % of Nd, 5.0 mass % of Pr, 10.00 mass % of Dy, 1.00 mass % of B, 0.90 mass % of Co, 0.1 mass % of Cu, 0.20 mass % of Al, and Fe as the balance was also melted with a strip caster and then quenched and solidified, thereby making thin alloy flakes with thicknesses of 0.2 mm to 0.3 mm.

Next, two containers were loaded with these two types of thin alloy flakes and then introduced into a furnace for hydrogen absorption, which was filled with a hydrogen gas atmosphere at a pressure of 500 kPa. In this manner, hydrogen was occluded into the thin alloy flakes at room temperature and then desorbed. By performing such a hydrogen process, the alloy flakes were decrepitated to obtain a powder in indefinite shapes with sizes of about 0.15 mm to about 0.2 mm.

Thereafter, 0.05 mass % of zinc stearate was added as an aid for pulverization to each coarsely pulverized powder obtained by the hydrogen process and then the mixture was pulverized with a jet mill to obtain fine powders with a particle size of approximately 4 μm. After that, 0.1 mass % of zinc stearate was further added to each of the finely pulverized powders and then mixed with the powder, thereby adjusting the content of C to 1,000 ppm in each finely pulverized powder.

Among the fine powders thus obtained, the fine powder made of Material Alloy #1 and the fine powder made of Material Alloy #2 were compacted separately with a press machine to obtain two powder compacts a and b. More specifically, the powder particles of Material Alloy #1 or #2 were compressed and compacted while being aligned with a magnetic field of 1.5 T applied. Subsequently, the green compacts were unloaded from the press machine and then the compacts a and b that were still stacked one upon the other were subjected to a sintering process at 1,050° C. for four hours in a vacuum furnace.

In this manner, sintered blocks were obtained and then machined and cut into sintered magnet bodies with a thickness of 3 mm, a length of 14 mm (in the magnetizing direction) and a width of 8 mm (in the compacting direction).

Meanwhile, a sample representing Comparative Example 1 was also made.

Comparative Example 1

First, an ingot of Material Alloy #1 that had been prepared so as to have a composition including 26.0 mass % of Nd, 5.0 mass % of Pr, less than 0.05 mass % of Dy, 1.00 mass % of B, 0.90 mass % of Co, 0.1 mass % of Cu, 0.20 mass % of Al, and Fe as the balance was melted, quenched and solidified by strip casting method as described above, thereby making thin alloy flakes with thicknesses of 0.2 mm to 0.3 mm.

In the meantime, an ingot of Material Alloy #2 that had been prepared so as to have a composition including 16.5 mass % of Nd, 5.0 mass % of Pr, 10.00 mass % of Dy, 1.00 mass % of B, 0.90 mass % of Co, 0.1 mass % of Cu, 0.20 mass % of Al, and Fe as the balance was also melted, quenched and solidified by strip casting method as described above, thereby making thin alloy flakes with thicknesses of 0.2 mm to 0.3 mm.

Next, two containers were loaded with these two types of thin alloy flakes and then introduced into a furnace for hydrogen absorption, which was filled with a hydrogen gas atmosphere at a pressure of 500 kPa. In this manner, hydrogen was occluded into the thin alloy flakes at room temperature and then desorbed. By performing such a hydrogen process, the thin alloy flakes were decrepitated to obtain a powder in indefinite shapes with sizes of about 0.15 mm to about 0.2 mm.

Thereafter, 0.05 mass % of zinc stearate was added as an aid for pulverization to each coarsely pulverized powder obtained by the hydrogen process and then the mixture was pulverized with a jet mill to obtain fine powders with a particle size of approximately 4 μm. After that, 0.1 mass % of zinc stearate was further added to each of the finely pulverized powders and then mixed with the powder, thereby adjusting the content of C to 1,000 ppm in each finely pulverized powder.

Among the fine powders thus obtained, the fine powder made of Material Alloy #1 and the fine powder made of Material Alloy #2 were compacted separately with a press machine to obtain two powder compacts c and d. More specifically, the powder particles of Material Alloy #1 or #2 were compressed and compacted while being aligned with a magnetic field of 1.5 T applied. Subsequently, the green compacts were unloaded from the press machine and then subjected to a sintering process at 1,050° C. for four hours in a vacuum furnace.

In this manner, sintered blocks c and d were obtained and then machined and cut into sintered magnet bodies with a thickness of 3 mm, a length of 7 mm (in the magnetizing direction) and a width of 8 mm (in the compacting direction). After that, these sintered magnet bodies made of Material Alloys #1 and #2 were bonded together in the magnetizing direction with an adhesive (such as two-component epoxy resin adhesives AV138 and HV998 produced by Nagase ChemteX Corporation) to obtain a block of a sintered magnet.

Comparative Example 2

First, an ingot of Material Alloy #3 that had been prepared so as to have a composition including 26.0 mass % of Nd, 5.0 mass % of Pr, less than 0.05 mass % of Dy, 1.0 mass % of B, 0.90 mass % of Co, 0.1 mass % of Cu, 0.20 mass % of Al, and Fe as the balance was melted, quenched and solidified by strip casting method as described above, thereby making thin alloy flakes with thicknesses of 0.2 mm to 0.3 mm.

Next, a container was loaded with these thin alloy flakes and then introduced into a furnace for hydrogen absorption, which was filled with a hydrogen gas atmosphere at a pressure of 500 kPa. In this manner, hydrogen was occluded into the thin alloy flakes at room temperature and then desorbed. By performing such a hydrogen process, the thin alloy flakes were decrepitated to obtain a coarsely pulverized powder in indefinite shapes with sizes of about 0.15 mm to about 0.2 mm.

Thereafter, 0.05 mass % of zinc stearate was added as an aid for pulverization to the coarsely pulverized powder obtained by the hydrogen process and then the mixture was pulverized with a jet mill to obtain a fine powder with a particle size of approximately 4 μm. After that, 0.1 mass % of zinc stearate was further added to the finely pulverized powder and then mixed with the powder, thereby adjusting the content of C to 1,000 ppm in the finely pulverized powder.

Subsequently, the fine powder made of Material Alloy #3 was compacted with a press machine to obtain a powder compact e. More specifically, the powder particles of Material Alloy #3 were compressed and compacted while being aligned with a magnetic field of 1.5 T applied. Subsequently, the green compact was unloaded from the press machine and then subjected to a sintering process at 1,050° C. for four hours in a vacuum furnace.

In this manner, a sintered block was obtained and then machined and cut into sintered magnets with a thickness of 3 mm, a length of 14 mm (in the magnetizing direction) and a width of 8 mm (in the compacting direction).

These samples had their three-point bending strength measured using a machine LSC-1/30 produced by J T Toshi at a span to span distance of 9 mm and a cross head speed of 1 mm/min, thereby comparing Examples #1 and #2 to each other with respect to the transverse strength of Comparative Example #2 that was 300 MPa.

As a result, the transverse strength of the sintered magnet of Example #1 was almost the same as that of Comparative Example #2. On the other hand, the transverse strength of Example #2 was approximately two-thirds of that of Comparative Example #2.

On each of these samples, it was measured how long it took to obtain a sintered body to make an R-T-B based sintered magnet, including a region with relatively high remanence Br and a region with relatively high coercivity $H_{cJ}$. And Examples #1 and #2 were compared to each other with respect to the time it took to make the sintered magnet of Comparative Example #1. The working times it took to make the sintered magnets of Examples #1 and #2 could be shortened overall because the time for getting the bonding process done could be saved compared to Comparative Example #1, although it took an additional time to get the compaction process done.

Figure 6:
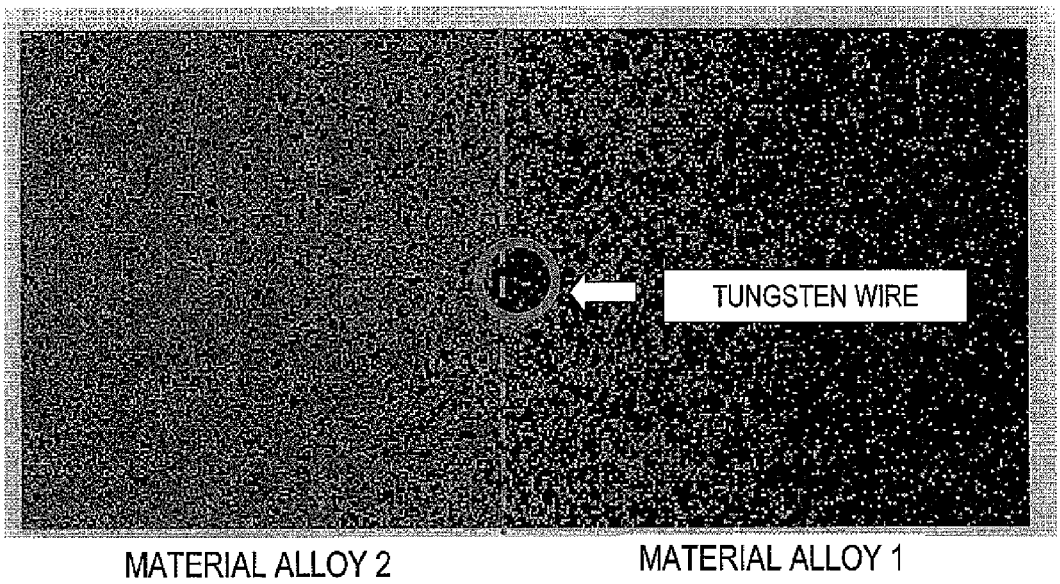
FIG. 6 is an EPMA mapped image showing a cross section of a sintered body representing Example #1.

Next, these samples were cut. And then an EPMA mapping test was carried out using a machine called EPMA1610, produced by Shimadzu Corporation, with an accelerating voltage of 15 kV applied, with a beam current of 100 nA supplied, and at a beam exposure time of 1 sec/point to see how Dy diffused in Example #1. As a result, it was confirmed that Dy, heavy rare-earth element RH, diffused from a high coercivity portion of Material Alloy #2 including a lot of the heavy rare-earth element RH as the rare-earth element R toward a high Br portion of Material Alloy #1 including a smaller amount of the heavy rare-earth element RH as the rare-earth element R as shown in FIG. 6. In the example shown in FIG. 6, a piece of metal tungsten was interposed as a mark indicating the junction between the green compacts yet to be sintered.

As described above, according to any of the various manufacturing processes of various preferred embodiments of the present invention, multiple compacts including the heavy rare-earth element RH at mutually different concentrations are sintered at the same time while making a close contact with each other. That is why not only the powder particles that form those compacts, but also the compacts themselves, are combined together through the sintering process. However, those compacts will shrink to mutually different degrees during that sintering process due to a difference in the concentration of the heavy rare-earth element RH between them. For that reason, the final sintered magnet, obtained by combining those compacts together, could be deformed in some cases.

To minimize such deformation of the sintered magnet, at least one of the following five process parameters is preferably changed between the compact to be a high coercivity portion and the compact to be a high Br portion:

(1) Compacting pressure (green density);
(2) The amount of a lubricant to be added to the powder to make each compact (as a shrinkage reducer M1 (C));
(3) The amount of another shrinkage reducer M2 (which is at least one of Al, Co, Ni, Cu and Sn) to be added to the powder to make each compact;
(4) The powder particle size of the magnetic powder to make each compact; and
(5) The respective total R mole fractions of Material Alloys #1 and #2 and their $R_H$ mole fractions.

Hereinafter, specific examples of preferred embodiments of the present invention, in which these parameters are adjusted, will be described.

First of all, three types of Material Alloy Powders A, B and C were provided so as to have mutually different Dy concentrations as shown in the following Table 1:

TABLE 1

| Powder | Nd (mass %) | Pr (mass %) | Dy (mass %) | B (mass %) | Co (mass %) | Cu (mass %) | Al (mass %) | Fe (mass %) |
|---|---|---|---|---|---|---|---|---|
| A | 26.2 | 4.8 | 0.0 | 1.0 | 0.9 | 0.1 | 0.2 | Bal |
| B | 20.1 | 6.0 | 5.0 | 1.0 | 0.9 | 0.1 | 0.2 | Bal |
| C | 16.6 | 5.1 | 10.0 | 1.0 | 0.9 | 0.1 | 0.2 | Bal |

This Table 1 and the following Table 2 show the respective compositions of Material Alloy Powders A, B and C, the green densities of the compacts obtained by compressing and compacting those powders, and their sintering shrinkage rates. The pulverized particle sizes D50 of the respective powders were adjusted to 4.70 μm. The compacts were made in quite the same way as in Example #1 except the parameters shown in these Tables 1 and 2:

In this example, 0.3 mass % of a lubricant (that is a liquid fatty ester) was added to each material alloy powder, which was then compressed and compacted under a compacting pressure of 0.34 ton/cm$^2$. After that, each of the compacts thus obtained was sintered at 1,050° C. for four hours. The sintering shrinkage rates were measured in the magnetic field alignment direction (i.e., M direction) and in a direction perpendicular to the M direction and the compacting direction (i.e., K direction). As can be seen from Table 1, the shrinkage rate varied according to the Dy concentration of the material alloy powder.

The data shown in Table 2 was collected separately from a green compact made of Material Alloy Powder A and its sintered compact, a green compact made of Material Alloy Powder B and its sintered compact, and a green compact made of Material Alloy Powder C and its sintered compact.

Hereinafter, manufacturing process conditions and ratings of sintered magnets representing specific examples of preferred embodiments of the present invention, each including multiple regions with mutually different Dy concentrations, will be described. Those sintered magnets representing specific examples of preferred embodiments of the present invention were produced following three different manufacturing process flows under various conditions with mutually different process parameters described above.

The following Table 3 summarizes manufacturing process conditions and the shapes and bond strengths of sintered magnets as final products for Samples No. 1-1 through No. 1-11 representing specific examples of the present invention. The sintered magnets of those specific examples were produced by performing the respective manufacturing process steps of feeding powder, forming a temporary compact, feeding powder again, compacting the powder and then sintering in this order:

TABLE 2

| | Pulverized | Lubricant | | Compacting | | Sintering | | |
|---|---|---|---|---|---|---|---|---|
| | particle | | Amount | pressure | Green | temperature | Shrinkage rate (%) | |
| Powder | size D50 (μm) | Type | (mass %) | (ton/cm$^2$) | density (g/cm$^3$) | (° C.) | M direction | K direction |
| A | 4.70 | Fatty | 0.15 | 0.34 | 4.18 | 1050 | 27.0 | 12.6 |
| B | | ester | | | 4.22 | | 26.6 | 12.8 |
| C | | | | | 4.25 | | 25.8 | 12.0 |

TABLE 3

| Sample No. | Manufacturing method | Combination | | 1st stage temporary compact density (g/cm³) | Additional conditions | Sintering temperature (° C.) | Rating Shape | Rating Bond strength | C content (ppm) |
|---|---|---|---|---|---|---|---|---|---|
| 1-1 | Feed powder | A | B | 4.18 | None | 1050° C. | ◎ | ○ | 800 |
| 1-2 | ↓ | B | C | 4.22 | None | | ○ | | 800 |
| 1-3 | Form | A | C | 4.18 | None | | ○ | | 800 |
| 1-4 | temporary compact ↓ | B | C | 4.25 | B: increase compacting pressure while forming temporary compact | | ◎ | | 800 |
| 1-5 | Feed powder ↓ Form compact | A | C | 4.35 | A: increase compacting pressure while forming temporary compact | | ◎ | | 800 |
| 1-6 | ↓ Sinter | B | C | 4.24 | B: add another 0.05 mass % of lubricant | | ◎ | | 850 |
| 1-7 | | A | C | 4.28 | A: add another 0.08 mass % of lubricant | | ◎ | | 880 |
| 1-8 | | B | C | 4.22 | B: add 0.10 mass % of Sn powder | | ◎ | | 800 |
| 1-9 | | A | C | 4.18 | A: add 0.19 mass % of Sn powder | | ◎ | | 800 |
| 1-10 | | B | C | 4.24 | B: D50 = 4.80 μm | | ◎ | | 800 |
| 1-11 | | A | C | 4.28 | A: D50 = 5.10 μm | | ◎ | | 800 |

In Table 3, the "combination" indicates the type of the powder to be loaded first into the cavity of the press machine (on the left-hand side) and that of the powder to be loaded into the cavity after a temporary compact has been formed (on the right-hand side). As for Sample No. 1-1, for example, Material Alloy Powder A was fed first, a temporary compact of the Material Alloy Powder A was formed as a first-stage temporary compact, Material Alloy Powder B was fed onto that temporary compact, and then a compaction process was carried out for the second time. As a matter of principle, each of the two compaction processes was carried out with a compacting pressure of 0.34 ton/cm$^2$ applied. In Table 3, the "first-stage temporary compact density" indicates the density of the temporary compact that was obtained by performing the first-stage compaction process.

Table 3 also has an "additional condition" column. As for Sample No. 1-4, for example, the "additional condition" was that the compacting pressure be increased from 0.34 ton/cm$^2$ to a standard pressure of 0.5 ton/cm$^2$ for forming a temporary compact of Material Alloy Powder B. In the same way, the "additional condition" for Sample No. 1-5 was that the compacting pressure be increased from 0.34 ton/cm$^2$ to a standard pressure of 0.73 ton/cm$^2$ for forming a temporary compact of Material Alloy Powder A. Once the powder feeding process step was done for the second time, the compacting pressure applied during the compaction process was fixed at 0.34 ton/cm$^2$. As for Samples Nos. 1-4 and 1-5, the compacting pressure during the first stage compaction process was increased because the first stage temporary compact had a Dy concentration that was too low to avoid shrinking. That is why the green compact density was increased to reduce the shrinkage rate.

The "additional condition" for Sample No. 1-6 was that not only a lubricant (such as a liquid fatty acid ester) in a standard amount of 0.15 mass % but also another 0.05 mass % of the lubricant were added to the Material Alloy Powder B. That is to say, 0.20 mass % of lubricant was added to the Material Alloy powder B in total. Likewise, the "additional condition" for Sample No. 1-7 was that not only a lubricant in a standard amount of 0.15 mass % but also another 0.08 mass % of the lubricant were added to the Material Alloy Powder A. That is to say, 0.23 mass % of lubricant was added to the Material Alloy powder A in total. As for Samples Nos. 1-6 and 1-7, the amount of the lubricant added to the first stage temporary compact was increased because the first stage temporary compact had a Dy concentration that was too low to avoid shrinking. That is why the amount of the lubricant added was increased so that the green compact density would increase even with the same compacting pressure, thereby reducing the shrinkage rate. That is to say, an increased amount of C functions as not only a lubricant but also a shrinkage reducer as well.

The "additional condition" for Sample No. 1-8 was that 0.10 mass % of Sn powder be added as a shrinkage reducer M to Material Alloy Powder B. Likewise, the "additional condition" for Sample No. 1-9 was that 0.19 mass % of Sn powder be added as a shrinkage reducer M to Material Alloy Powder A. As for Samples Nos. 1-8 and 1-9, the shrinkage reducer M was added to the first-stage temporary compact because the first-stage temporary compact had a Dy concentration that was too low to avoid shrinking. That is why the shrinkage reducer M was added to reduce the shrinkage rate.

The "additional condition" for Sample No. 1-10 was that the pulverized particle size D50 of Material Alloy Powder B be increased from a standard value of 4.70 μm to 4.80 μm. Likewise, the "additional condition" for Sample No. 1-11 was that the pulverized particle size D50 of Material Alloy Powder A be increased from the standard value of 4.70 μm to 5.10 μm. As for Samples Nos. 1-10 and 1-11, the pulverized particle size of the powder to make the first-stage temporary compact was increased because the first-stage temporary compact had a Dy concentration that was too low to avoid shrinking. That is why the particle size of the powder was increased so that the green compact density would increase even with the same compacting pressure, thereby reducing the shrinkage rate.

The other process parameters not mentioned in the "additional condition" column were defined to be the same for every sample.

The "shape" column of Table 3 indicates whether or not the difference in shrinkage rate in the M direction between those regions with mutually different Dy concentrations during the sintering process was equal to or smaller than a predetermined value. In this column, the double circle ◎ means that the difference in shrinkage rate was 0.5% or less, while the open circle ○ indicates that the difference in shrinkage rate was greater than 0.5% but equal to or smaller than 1.5%. In every specific example of a preferred embodiment of the present invention but samples Nos. 1-2 and 1-3, the difference in shrinkage rate was 0.5% or less. However, the shrinkage rates of the regions with mutually different Dy concentrations could be reduced by adjusting those process parameters. As a result, the deformation of the sintered magnet could be reduced sufficiently.

In Table 3, the "bond strength" was rated by measuring their three-point bending transverse strength with a machine LSC-1/30 produced by J T Toshi at a span to span distance of 9 mm and a cross head speed of 1 mm/min. Samples of which the compacts came off are indicated by the cross "x", while samples of which the compacts did not come off are indicated by the open circle of "○".

In each of the specific examples shown in Table 3, the process steps of feeding powder, forming a temporary compact, feeding powder again and forming a compact were performed using a single press machine, and then a compact consisting of two different kinds of material alloy powders (i.e., a second-stage compact) was sintered. On the other hand, each of the specific examples of preferred embodiments of the present invention to be described below (as Samples Nos. 2-1 through 2-11) with reference to Table 4 was obtained by forming two temporary compacts separately by two different series of compaction process steps, combining those two temporary compacts together with a press machine, and then sintering the combined compacts.

TABLE 4

| Sample No. | Manufacturing method | Combination | | Provisional compacts densities ($g/cm^3$) | | Additional conditions | Sintering temperature (° C.) | Rating Shape | Rating Bond strength | C content (ppm) |
|---|---|---|---|---|---|---|---|---|---|---|
| 2-1 | Form | A | B | 4.18 | 4.22 | None | 1050° C. | ◎ | ○ | 800 |
| 2-2 | temporary | B | C | 4.22 | 4.25 | None | | ○ | | 800 |
| 2-3 | compacts by | A | C | 4.18 | 4.25 | None | | ○ | | 800 |
| 2-4 | two series of compaction process steps | B | C | 4.25 | 4.25 | B: increase compacting pressure while forming temporary compact | | ◎ | | 800 |
| 2-5 | ↓ Combine those temporary | A | C | 4.30 | 4.25 | A: increase compacting pressure while forming temporary compact | | ◎ | | 800 |
| 2-6 | compacts together | B | C | 4.24 | 4.25 | B: add another 0.05 mass % of lubricant | | ◎ | | 850 |
| 2-7 | | A | C | 4.28 | 4.25 | A: add another 0.08 mass % of lubricant | | ◎ | | 880 |
| 2-8 | | B | C | 4.22 | 4.25 | B: add 0.10 mass % of Sn powder | | ◎ | | 800 |
| 2-9 | | A | C | 4.18 | 4.25 | A: add 0.19 mass % of Sn powder | | ◎ | | 800 |
| 2-10 | | B | C | 4.24 | 4.25 | B: D50 = 4.80 μm | | ◎ | | 800 |
| 2-11 | | A | C | 4.28 | 4.25 | A: D50 = 5.10 μm | | ◎ | | 800 |

In Table 4, the "temporary compacts densities" column shows the respective densities of the two temporary compacts to be compacted in combination. However, the "additional condition" column of Table 4 is the same as that of Table 3, and the description thereof will be omitted herein.

In every specific example shown in Table 4 but Samples Nos. 2-2 and 2-3, the difference in shrinkage rate could be reduced to 0.5% or less and the deformation of the sintered magnet could be minimized. Also, even in those Samples Nos. 2-2 and 2-3, the difference in shrinkage rate could be reduced to be more than 0.5% but equal to or smaller than 1.5%. That is to say, even when two temporary compacts provided separately were combined together by compaction process, the difference in shrinkage rate between those regions with mutually different Dy concentrations could also be narrowed by adjusting the process parameters described above. As a result, the deformation of the sintered magnet could be minimized, too.

TABLE 5

| Sample No. | Manufacturing method | Combination | | Provisional compacts densities ($g/cm^3$) | | Additional conditions | Load 200 g | Sintering temperature (° C.) | Rating Shape | Rating Bond strength | C content (ppm) |
|---|---|---|---|---|---|---|---|---|---|---|---|
| 3-1 | Form compacts | A | B | 4.18 | 4.22 | None | Not | 1050° C. | — | X | — |
| 3-2 | ↓ | B | C | 4.22 | 4.25 | None | placed | | — | | — |

TABLE 5-continued

| Sample No. | Manufacturing method | Combination | | Provisional compacts densities ($g/cm^3$) | | Additional conditions | Load 200 g | Sintering temperature (° C.) | Rating Shape | Rating Bond strength | C content (ppm) |
|---|---|---|---|---|---|---|---|---|---|---|---|
| 3-3 | Stack and | A | C | 4.18 | 4.25 | None | | | — | | — |
| 3-4 | sinter those | A | B | 4.19 | 4.26 | None | Placed | | ◎ | ○ | 800 |
| 3-5 | compacts | B | C | 4.19 | 4.27 | None | | | ○ | | 800 |
| 3-6 | together | A | C | 4.19 | 4.29 | None | | | ○ | | 800 |
| 3-7 | | B | C | 4.25 | 4.25 | B: increase compacting pressure | | | ◎ | | 800 |
| 3-8 | | A | C | 4.30 | 4.25 | A: increase compacting pressure | | | ◎ | | 800 |
| 3-9 | | B | C | 4.24 | 4.25 | B: add another 0.05 mass % of lubricant | | | ◎ | | 850 |
| 3-10 | | A | C | 4.28 | 4.25 | A: add another 0.08 mass % of lubricant | | | ◎ | | 880 |
| 3-11 | | B | C | 4.22 | 4.25 | B: add 0.10 mass % of Sn powder | | | ◎ | | 800 |
| 3-12 | | A | C | 4.18 | 4.25 | A: add 0.19 mass % of Sn powder | | | ◎ | | 800 |
| 3-13 | | B | C | 4.24 | 4.25 | B: D50 = 4.80 μm | | | ◎ | | 800 |
| 3-14 | | A | C | 4.28 | 4.25 | A: D50 = 5.10 μm | | | ◎ | | 800 |

The sintered magnet of each of the examples shown in Table 5 was produced by stacking two compacts that had been formed separately so as to have mutually different Dy concentrations and then sintering them. Specifically, each of the samples Nos. 3-1, 3-2 and 3-3 shown in Table 5 was obtained by just stacking the two compacts one upon the other and sintering them. As for the other samples, a stainless steel plate with a weight of 200 g was put on the stack of the two compacts before they were sintered. The present inventors discovered that when load was placed with the stainless steel plate, the degree of close contact between the two compacts increased so much that the bond strength of the resultant sintered magnet reached a sufficiently high level. On the other hand, if those two compacts were just stacked one upon the other, the bond strength was insufficient, and therefore, the junction came off with even a little impact (in Samples Nos. 3-1 to 3-3). In this case, the magnitude of the load to be placed on the stack of compacts is preferably defined to be an appropriate value according to the area of contact between the compacts or the weights of the compacts themselves.

Even in the specific examples shown in Table 5, Samples No. 3-4 and Nos. 3-7 through 3-11 had a shrinkage rate difference of 0.5% or less and the deformation of the sintered magnet could be minimized. And even Samples Nos. 3-5 and 3-6 also had a shrinkage rate difference of more than 0.5% to 1.5% or less.

The bond strength (i.e., transverse strength) of the samples shown in Table 4 was compared with respect to that of the samples shown in Table 3 (that was 300 MPa). As a result, the bond strength of every sample shown in Table 4 was approximately 70% of that of the samples shown in Table 3.

Meanwhile, the bond strength (i.e., transverse strength) of the samples shown in Table 5 was compared with respect to that of the samples shown in Table 3 (that was 300 MPa). As a result, the present inventors discovered that the bond strength (or transverse strength) of every sample with the "good" mark ○ in Table 5 was approximately 70% of that of the samples shown in Table 3. On the other hand, the bond strength (or transverse strength) of every sample with the "bad" mark x in Table 5 was only 10% of that of the samples shown in Table 3.

In the sintered magnet of each of the specific examples of preferred embodiments of the present invention described above, two regions with mutually different Dy concentrations are combined together by going through a sintering process. However, a single sintered magnet may also be formed by combining three or more regions with mutually different Dy concentrations together by sintering process. Also, the compacts yet to be sintered may have any arbitrary shapes or sizes. Likewise, compacts that form a single sintered magnet may also be combined arbitrarily.

Preferred embodiments of the present invention provide an R-T-B based sintered magnet, including a region with high remanence Br and a region with high coercivity $H_{cJ}$, without using any adhesive.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. An R-T-B based sintered magnet comprising:

a light rare-earth element $R_L$, which is at least one of Nd and Pr, a heavy rare-earth element $R_H$, which is at least one of Dy and Tb, and $Nd_2Fe_{14}B$ type crystals as a main phase; wherein a first region, which includes the heavy rare-earth element $R_H$ in a first concentration of zero or more heavy rare-earth elements $R_H$, and a second region, which includes the heavy rare-earth element $R_H$ in a second concentration that is higher than the first concentration, are stacked in layers such that the layers extend across an entire length or width of the R-T-B based sintered magnet; and the first and second regions are sintered and combined together.

2. The R-T-B based sintered magnet of claim 1, further comprising a shrinkage reducer M, which is at least one element selected from the group consisting of C, Al, Co, Ni, Cu and Sn.

3. The R-T-B based sintered magnet of claim 2, wherein the shrinkage reducer M has a higher concentration in the first region than in the second region.

4. The R-T-B based sintered magnet of claim 2, wherein the first region includes about 50 ppm to about 3,000 ppm of C as M1 that is one of the shrinkage reducers M.

5. The R-T-B based sintered magnet of claim 2, wherein the first region includes at least one element selected from the group consisting of Al, Co, Ni, Cu and Sn as M2 that is another one of the shrinkage reducers M, the content of M2 being equal to or greater than about 0.02 mass %.

6. The R-T-B based sintered magnet of claim 1, wherein each of the first and second regions has a thickness of at least about 0.1 mm and the magnet has a thickness of at least about 1.0 mm.

7. The R-T-B based sintered magnet of claim 1, further comprising a region in which the heavy rare-earth element $R_H$ has diffused on a boundary between the first and second regions.

8. The R-T-B based sintered magnet of claim 1, further comprising a region in which the concentration of the heavy rare-earth element $R_H$ has a gradient on a boundary between the first and second regions.

9. The R-T-B based sintered magnet of claim 8, wherein a portion of the first and second regions, which covers the surface of the magnet at least partially, includes a portion in which the heavy rare-earth element $R_H$ has a constant concentration from the surface of the magnet toward the boundary.

10. A method for producing an R-T-B based sintered magnet including both a light rare-earth element $R_L$, which is at least one of Nd and Pr, and a heavy rare-earth element $R_H$, which is at least one of Dy and Tb, and $Nd_2Fe_{14}B$ type crystals as a main phase, the method comprising the steps of:

providing a first material alloy powder, which includes either the heavy rare-earth element $R_H$ in a relatively low concentration or no heavy rare-earth elements $R_H$ at all, and a second material alloy powder, which includes the heavy rare-earth element $R_H$ in a relatively high concentration;

forming a composite compact including a first compact portion made of the first material alloy powder that extends across an entire length or width of the composite compact and a second compact portion made of the second material alloy powder that extends across the entire length or width of the composite compact; and sintering the composite compact, thereby making a sintered magnet in which the first and second compact portions have been combined together.

11. The method of claim 10, wherein the step of forming the composite compact includes:

a first forming process step for forming a temporary compact by loading a cavity, defined by a die, with one of the first and second material alloy powders and compressing the material alloy powder; and a second forming process step for forming the composite compact by loading the cavity defined by the die with the other alloy powder and compressing the material alloy powder along with the temporary compact.

12. The method of claim 10, wherein the step of forming the composite compact includes the steps of:

providing the first compact portion made of the first material alloy powder;

providing the second compact portion made of the second material alloy powder; and compressing the first and second compact portions, thereby forming the composite compact in which the first and second compact portions have been combined together.

13. The method of claim 10, wherein the step of forming the composite compact includes the steps of:

providing the first compact portion made of the first material alloy powder;

providing the second compact portion made of the second material alloy powder; and stacking the first and second compact portions one upon the other, thereby forming the composite compact in which the first and second compact portions are in contact with each other.

14. The method of claim 10, wherein the first and second material alloy powders include a shrinkage reducer M, which is at least one element selected from the group consisting of C, Al, Co, Ni, Cu and Sn, and the shrinkage reducer M has a higher concentration in the first material alloy powder than in the second material alloy powder.

15. The method of claim 10, wherein the first material alloy powder has a finer particle size than the second material alloy powder.

16. The method of claim 10, wherein in the step of forming the composite compact, the first compact portion made of the first material alloy powder has a higher green density than the second compact portion made of the second material alloy powder.

* * * * *